US008939315B2

(12) United States Patent
Pillow et al.

(10) Patent No.: US 8,939,315 B2
(45) Date of Patent: Jan. 27, 2015

(54) DUAL WHEELED PORTABLE COOLER

(71) Applicants: Carol Lee Pillow, Lexington, TN (US); Millard O'Neal Morgan, Lexington, TN (US)

(72) Inventors: Carol Lee Pillow, Lexington, TN (US); Millard O'Neal Morgan, Lexington, TN (US)

( * ) Notice: Subject to any disclaimer, the term of this patent is extended or adjusted under 35 U.S.C. 154(b) by 0 days.

(21) Appl. No.: 13/865,187

(22) Filed: Apr. 17, 2013

(65) Prior Publication Data

US 2014/0312044 A1 Oct. 23, 2014

(51) Int. Cl.
*B65D 81/38* (2006.01)
*F25D 3/08* (2006.01)

(52) U.S. Cl.
CPC . *B65D 81/38* (2013.01); *F25D 3/08* (2013.01)
USPC ..... 220/592.03; 220/763; 62/457.7

(58) Field of Classification Search
CPC ..... F25D 3/08; F25D 3/06; F25D 2331/804; A45C 11/20; A45C 13/262; A45C 13/26
USPC ..... 220/592.03, 592.02, 915.2, 915.1, 761, 220/762, 763; 62/457.7, 457.1
See application file for complete search history.

(56) References Cited

U.S. PATENT DOCUMENTS

| | | | | |
|---|---|---|---|---|
| 2,555,126 | A * | 5/1951 | Greve | 206/545 |
| 3,018,638 | A * | 1/1962 | Winkler | 62/237 |
| 4,932,677 | A * | 6/1990 | Shustack | 280/28.5 |
| 5,249,438 | A * | 10/1993 | Rhaney et al. | 62/457.7 |
| 5,313,817 | A * | 5/1994 | Meinders | 62/457.1 |
| 5,407,218 | A * | 4/1995 | Jackson | 280/30 |
| 5,465,985 | A * | 11/1995 | Devan et al. | 280/30 |
| 6,505,843 | B1 * | 1/2003 | Williams | 280/47.26 |
| 6,520,597 | B1 * | 2/2003 | Markling | 301/64.701 |
| 6,533,298 | B2 * | 3/2003 | Sims | 280/47.26 |
| 6,543,800 | B1 * | 4/2003 | Doran | 280/652 |
| 6,626,453 | B1 * | 9/2003 | Theus et al. | 280/652 |
| 6,637,835 | B2 * | 10/2003 | Morris | 301/111.01 |
| 6,739,150 | B2 * | 5/2004 | Mompo Garcia | 62/457.7 |
| 6,755,428 | B2 * | 6/2004 | Butler | 280/47.26 |
| 7,108,335 | B2 * | 9/2006 | Morris | 301/111.01 |
| 7,188,491 | B2 * | 3/2007 | Donald et al. | 62/457.7 |
| 7,559,559 | B2 * | 7/2009 | Vanderberg et al. | 280/47.26 |
| D613,560 | S * | 4/2010 | Robichaud et al. | D7/605 |
| 7,722,204 | B1 * | 5/2010 | Sandberg | 362/92 |
| 7,963,530 | B1 * | 6/2011 | Garcia | 280/30 |
| 8,147,005 | B2 * | 4/2012 | Morris | 301/64.701 |
| 2003/0024938 | A1 * | 2/2003 | Mompo Garcia | 220/592.03 |
| 2004/0237574 | A1 * | 12/2004 | Donald et al. | 62/457.7 |
| 2006/0237927 | A1 * | 10/2006 | Vanderberg et al. | 280/35 |
| 2014/0042797 | A1 * | 2/2014 | Pillow et al. | 301/64.706 |

* cited by examiner

*Primary Examiner* — Robert J Hicks

(57) ABSTRACT

This invention relates to a portable wheeled cooler having at least a cooler chest assembly consisting of four walls, a bottom having a cavity to receive a longitudinal shaft a hinged lid, a handle located on each end for lifting and carrying, a retractable support for carrying recreational items, two pair of removable oversized wheels supported by a longitudinal shaft such as an axle and restraining elements to secure said wheels to said longitudinal shaft.

1 Claim, 8 Drawing Sheets

DUAL WHEELED PORTABLE COOLER

BACKGROUND OF THE INVENTION

1. Field of the Invention

The subject matter relates to at least a portable food and beverage container resembling those used widely in the recreational industry. More specifically, to a wheeled portable ice chest, equipped with a retractable multiple bar support that allows for transporting recreational accessories.

A second embodiment of the invention consists of removable, dual, oversized wheels mounted at each end and secured to a single axle shaft. The dual, oversized wheel configuration allows for increased ground clearance along with a wide footprint which permits easy travel through, sand, gravel, mud, tall grass, and rough terrain.

A third embodiment of the invention is the retractable multiple bar support. This support allows a variety of recreational items to be transported on the lid of the cooler.

2. Description of the Art

The art of some form of wheeled ice chest used to carry food, drinks and other items to the beach, lake, river, ball fields and other locations is extensive. However, the fact is, those ice chest or coolers, can be seen being dragged or carried to their destination due to the poor design of their wheels and supporting elements. Their wheels are of little use once the cooler has moved off a smooth, hard surface. The invention provides the user the ability to transport food, beverages and recreational items to almost any destination without having to be dragged or carried. The large wheel design and increased ground clearance along with the retractable support are advantages not offered in prior art.

REFERENCES

| Document Number | Date | U.S. Patent Documents | Classification |
|---|---|---|---|
| a U.S. Pat. No. 6,505,843 B1 | January 2003 | Williams, Dale | 280/47.26 |
| b U.S. Pat. No. 4,932,677 A | June 1990 | Shustack, Leonard T. | 280/28.5 |
| c US-2006/0237927 A1 | October 2006 | Vanderberg et al. | 280/035 |
| d U.S. Pat. No. 5,313,817 A | May 1994 | Meinders, Larry | 62/457.1 |
| e U.S. Pat. No. 5,407,218 A | April 1995 | Jackson, Steven | 280/30 |
| f US-2004/0237574 A1 | December 2004 | Donald et al. | 062/457.7 |
| g U.S. Pat. No. 5,465,985 A | November 1995 | Devan et al. | 280/30 |

SUMMARY OF THE INVENTION

Food and beverage containers manufactured with small wheels do meet the mobile aspect requirements of the patent. However, these products can be seen being dragged or carried due to the inadequacy of their wheels and wheel support mechanism.

An embodiment of this invention is the use of large dual wheels on a single axle creating an asymmetrical appearance with large wheels protruding from each side of the cooler. Large, dual wheels increase the cooler's ground clearance and spreads the weight of the cooler and its contents across a wide footprint which allows the cooler to roll across sand, mud and other soft or irregular surfaces.

A second embodiment of this invention allows for the complete removal of the oversized wheels and its support elements. This allows for easy transportation and storage of the cooler.

A third embodiment of this invention is a multiple bar, retractable support. The support can be retracted for easier transportation and storage and extended to brace items being transported on the lid of the cooler.

DESCRIPTION OF THE PREFERRED EMBODIMENT

Referring now more particularly to the drawings, reference numbers will be used to denote the like parts or structure features in the different views.

Figure 1:
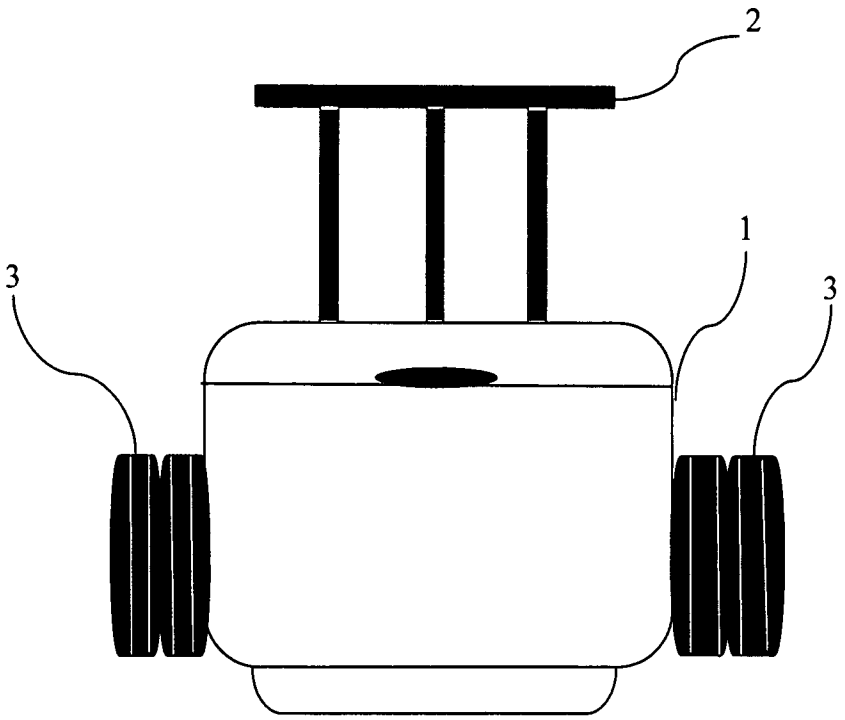
FIG. 1 is a frontal view of the dual wheeled portable cooler.
Figure 2:
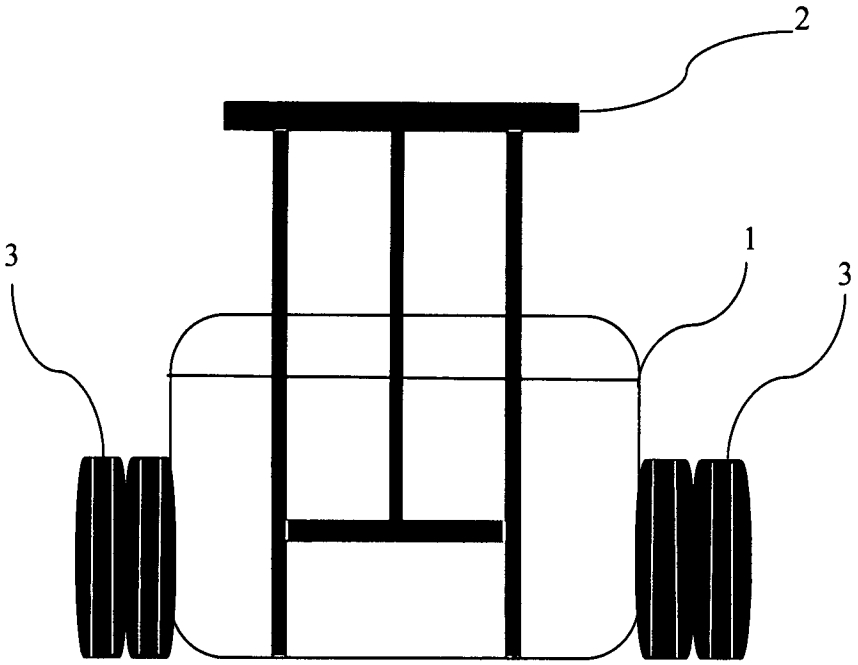
FIG. 2 is a rear view of the dual wheeled portable cooler.
Figure 3:
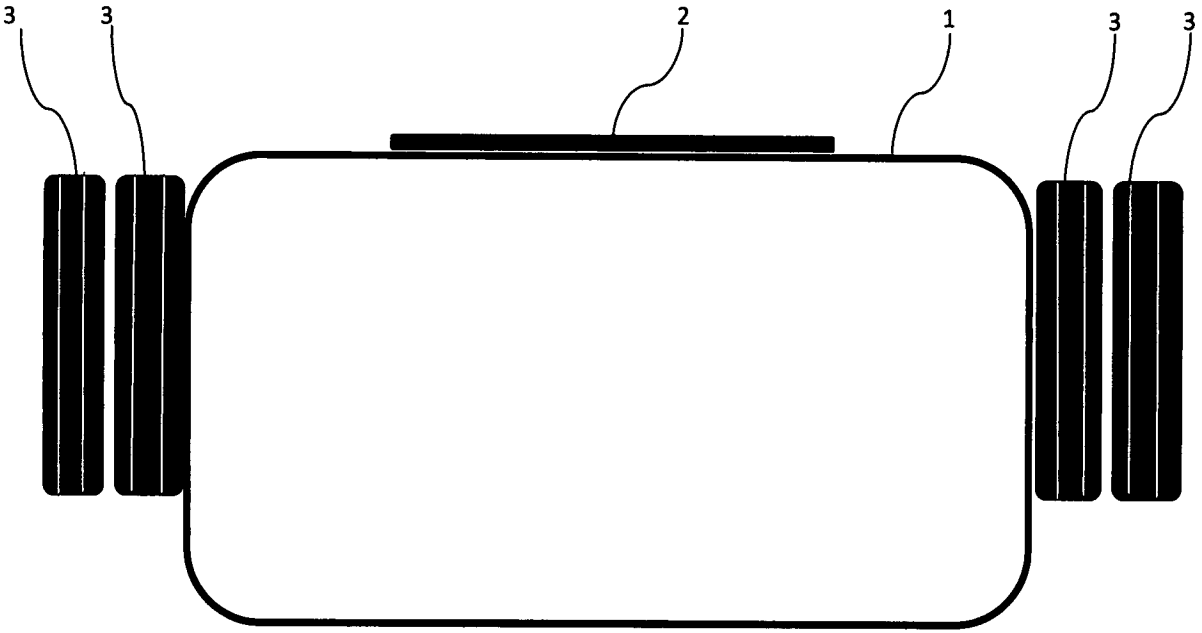
FIG. 3 is a top view of the dual wheeled portable cooler.
Figure 4:
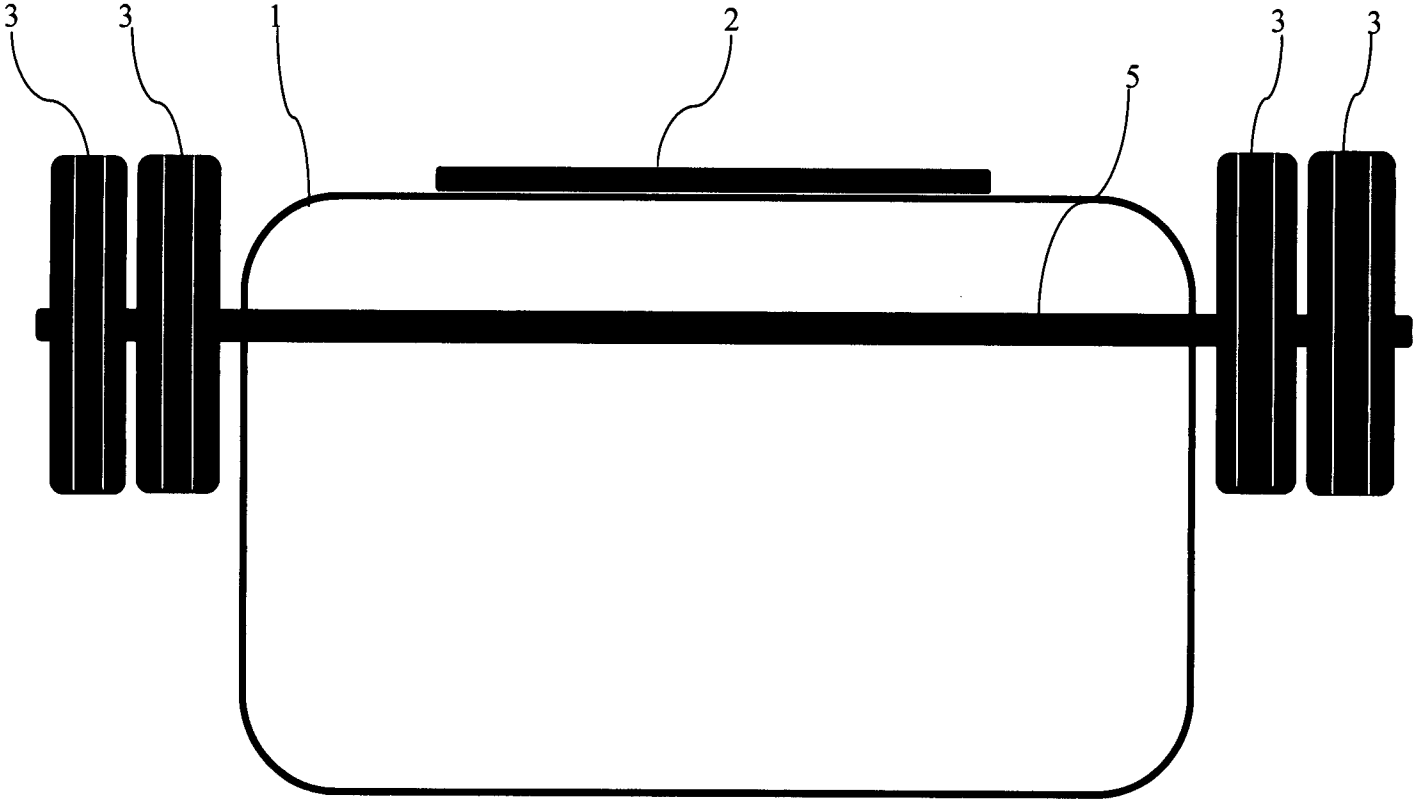
FIG. 4 is a view of the bottom of the dual wheeled portable cooler.

The cooler chest element of this invention referred to in FIG. 1 will be reference throughout with the number 1. That number will refer to a cooler chest assembly comprised of four walls, a bottom and a hinged lid.

The number 2 in FIG. 1 refers to the retractable multiple bar support and will be referenced throughout the views as number 2.

The number 3 in FIG. 1 refers to the solid molded cavernous body that is cast or molded in a unitary form of a rigid material such as plastic. At its center, number 3 FIG. 1 has an opening at each of its ends to receive a supporting element, such as an axle.

Figure 5:
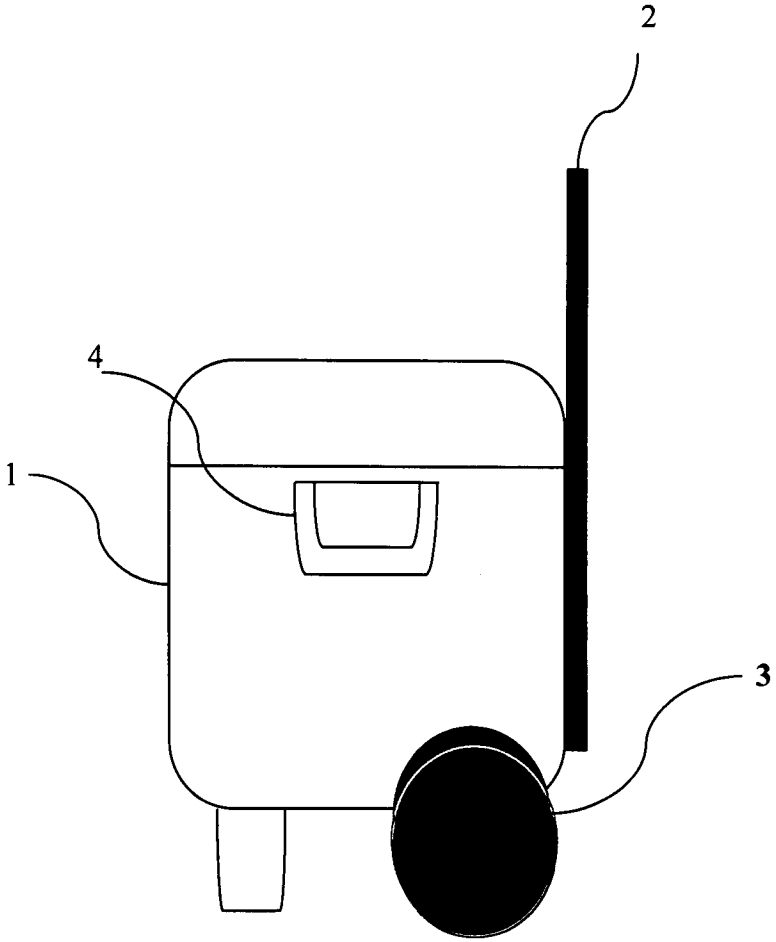
FIG. 5 is a side view of the dual wheeled portable cooler.

The number 4 in FIG. 5 refers to a carrying handle located at each end of number 1 FIG. 1 and will be referenced throughout as number 4.

Figure 6:
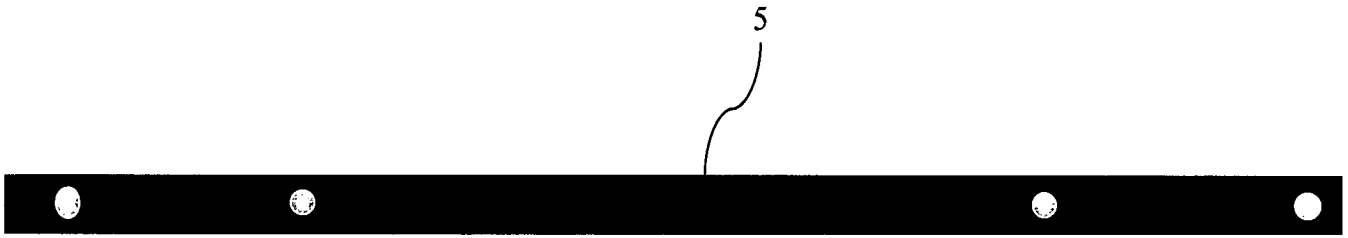
FIG. 6 is a front view of the axle shaft.

The number 5 in FIG. 6 refers to a supporting element made of hard metal, such as an axle, having cavities configured to receive a retaining element, and will be referenced throughout with the number 5.

Figure 7:
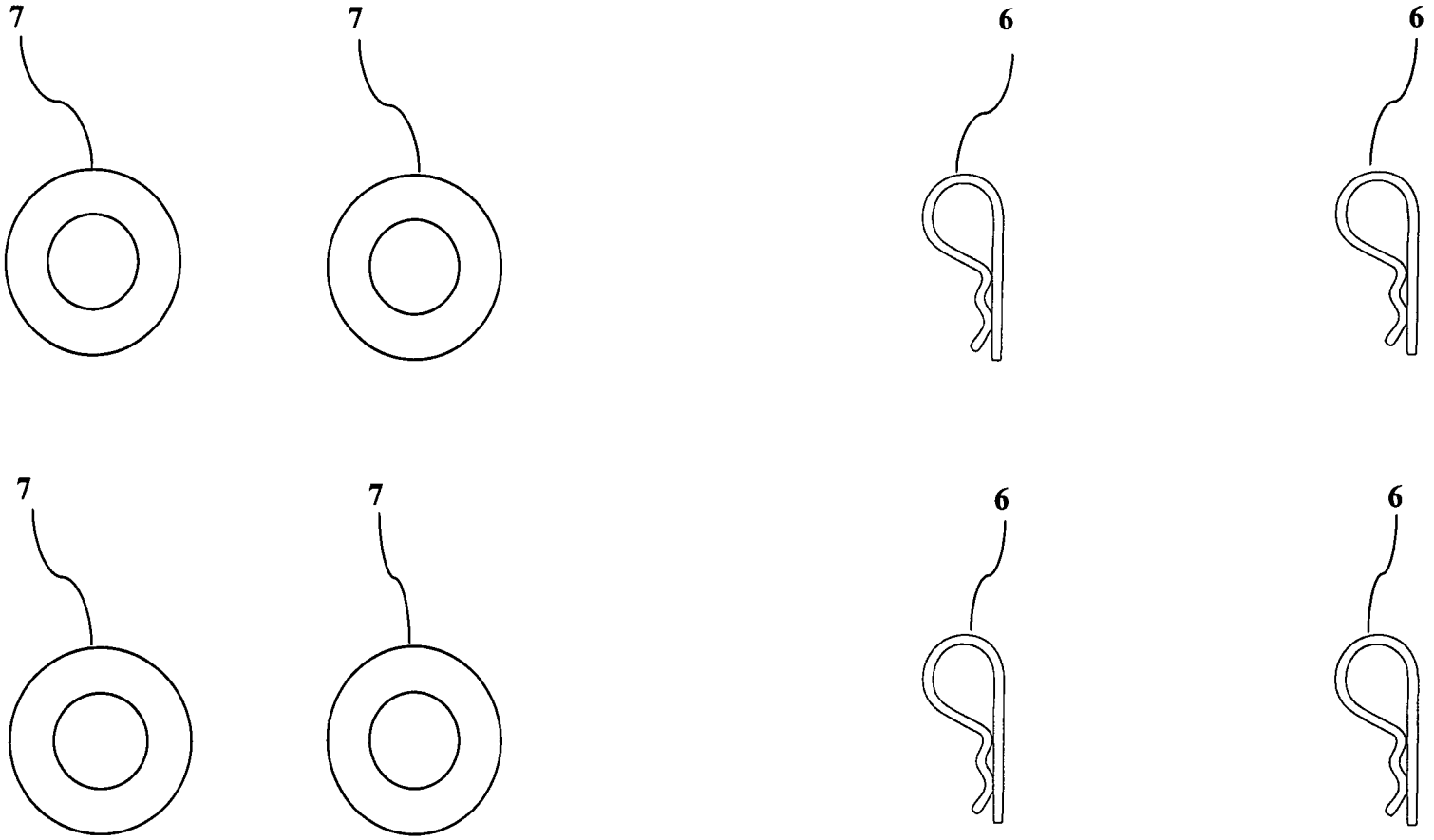
FIG. 7 is a front view of the wheel restraining elements.

The number 6 in FIG. 7 refers to a restraining element made of hard metal and designed to occupy the cavity of number 5 FIG. 6. This restraining element will be referenced throughout as number 6.

Figure 8:
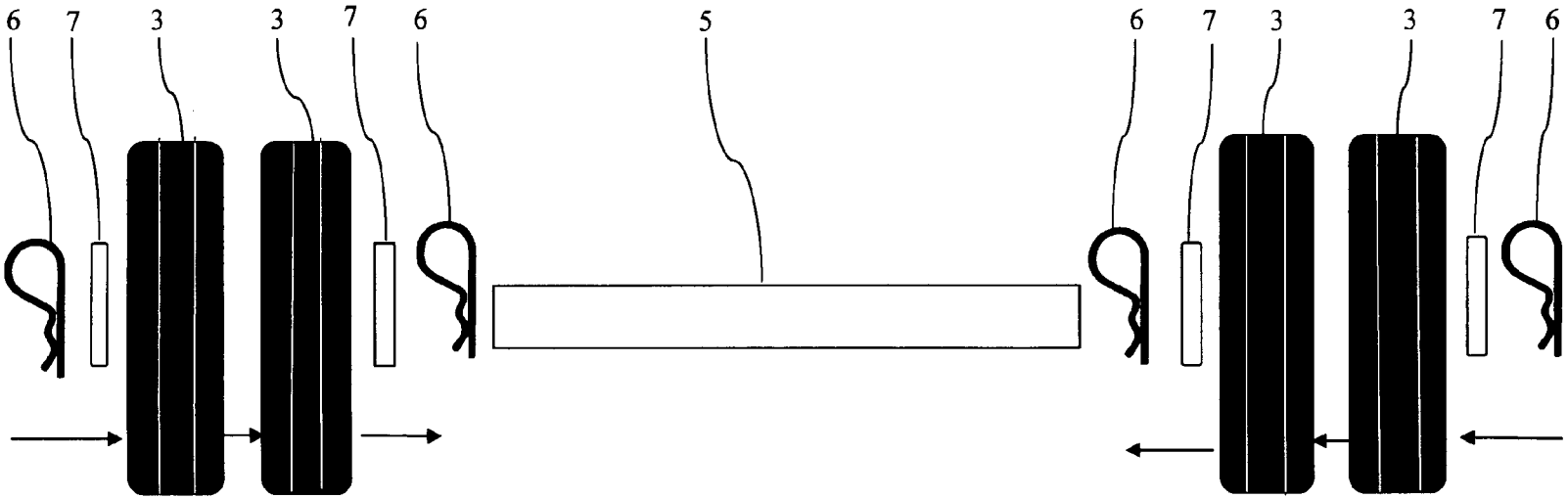
FIG. 8 is a front exploded view of the support elements of the cooler.

The number 7 in FIG. 8 refers to a drilled disc made of hard metal that occupies the space between number 3 and number 6. This drilled disc will be referenced throughout as number 7.

What is claimed is:

1. A dual wheeled portable cooler comprising:

an insulated enclosure;

a hinged lid covering an opening of said enclosure;

a plurality of wheels affixed to a stationary axle mounted on the bottom of said enclosure;

a carrying handle located at each end of said enclosure;

a retractable multiple bar support mounted on the rear wall of said enclosure, wherein a maximum width of said dual wheeled portable cooler is defined by said enclosure plus two wheels and restraining elements on each side of the rear wall of the cooler that provides ground clearance.

* * * * *